US010799879B2

(12) United States Patent
Liu

(10) Patent No.: US 10,799,879 B2
(45) Date of Patent: Oct. 13, 2020

(54) KITCHEN WASTE DISPOSAL SYSTEM

(71) Applicant: BECBAS (BEIJING) SCIENCE & TECHNOLOGY DEVELOPMENT CO., LTD., Beijing (CN)

(72) Inventor: Rui Liu, Beijing (CN)

(73) Assignee: BECBAS (BEIJING) SCIENCE & TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 16/745,297

(22) Filed: Jan. 16, 2020

(65) Prior Publication Data

US 2020/0284011 A1 Sep. 10, 2020

(30) Foreign Application Priority Data

Mar. 7, 2019 (CN) ..... 2019 1 0170900

(51) Int. Cl.
*B02C 25/00* (2006.01)
*E03C 1/266* (2006.01)
*B02C 18/00* (2006.01)

(52) U.S. Cl.
CPC ..... *B02C 25/00* (2013.01); *B02C 18/0084* (2013.01); *B02C 18/0092* (2013.01); *E03C 1/2665* (2013.01); *B02C 2201/063* (2013.01)

(58) Field of Classification Search
CPC ..... B02C 18/0084; B02C 18/0092; B02C 2201/063
USPC ..... 241/46.013, 46.016, 36
See application file for complete search history.

(56) References Cited

U.S. PATENT DOCUMENTS 3,425,637 A * 2/1969 Enright ..... E03C 1/2665 241/32.5
5,308,000 A * 5/1994 Riley ..... E03C 1/2665 241/33
5,539,166 A * 7/1996 Reier ..... E03C 1/2665 200/81 H
6,636,135 B1 * 10/2003 Vetter ..... B02C 25/00 241/46.013
7,500,626 B2 * 3/2009 Berger ..... E03C 1/2665 241/32.5
8,898,828 B2 * 12/2014 Aykens ..... E03C 1/048 4/653
D727,089 S * 4/2015 Hammer ..... D7/375
9,145,666 B2 * 9/2015 Hammer ..... B02C 18/0092
9,315,978 B2 * 4/2016 Aykens ..... E03C 1/048
9,752,307 B2 * 9/2017 Bewley, Jr. ..... E03C 1/2665
10,471,438 B2 * 11/2019 Chavez ..... B02C 18/12
(Continued)

*Primary Examiner* — Faye Francis

(57) ABSTRACT

The present disclosure provides a kitchen waste disposal system. The kitchen waste disposal system includes a garbage disposal having a top opening connected with a water outlet of a sink and a side opening connected with a drainage pipeline, an electric control valve in series with a water supply pipeline of the faucet, and a control box. The control box is configured to start the garbage disposal and turn on the electric control valve in response to a system starting signal. And the control box is further configured to stops the garbage disposal and shut the electric control valve in response to a completion state of a cleaning task of the garbage disposal. Based on present disclosure, start and stop of the garbage disposal and water source of the faucet are synchronously controlled by the control box, thereby simplifying manual operation of a user.

9 Claims, 3 Drawing Sheets

(56) References Cited

U.S. PATENT DOCUMENTS

| | | | | |
|---|---|---|---|---|
| 2003/0226918 | A1* | 12/2003 | Gerstel | B02C 25/00 241/30 |
| 2004/0251339 | A1* | 12/2004 | Strutz | B02C 25/00 241/30 |
| 2006/0011759 | A1* | 1/2006 | Chavez | B02C 18/24 241/46.013 |
| 2006/0138246 | A1* | 6/2006 | Stowe | E03C 1/05 236/12.12 |
| 2012/0151670 | A1* | 6/2012 | Aykens | E03C 1/048 4/619 |
| 2015/0267386 | A1* | 9/2015 | Bewley, Jr. | E03C 1/2665 241/15 |
| 2019/0210036 | A1* | 7/2019 | Chavez | B02C 25/00 |
| 2020/0061633 | A1* | 2/2020 | Chavez | B02C 23/36 |

* cited by examiner

KITCHEN WASTE DISPOSAL SYSTEM

The present disclosure relates to a field of smart home appliances, in particular to a kitchen waste disposal system.

BACKGROUND

A garbage disposal (commonly known as a waste disposer) is a household appliance dedicated to removing solid kitchen waste, which is usually installed under a kitchen sink, and grinds and discharges the solid kitchen waste by means of a water flow discharged from the sink.

However, control of starting or stopping the garbage disposal and control of water supplied from a faucet are independent from each other. This requires a user to manually control them separately. As a result, control of the garbage disposal is cumbersome.

SUMMARY

The present disclosure provides a kitchen waste disposal system. The kitchen waste disposal system includes a garbage disposal having a top opening connected with a water outlet of a sink and a side opening connected with a drainage pipeline and a control box.

The control box is configured to start the garbage disposal and open an electric control valve in series with a water supply pipeline of the faucet in response to a system starting signal. And the control box is further configured to stop the garbage disposal and shut the electric control valve in response to a completion state of a cleaning task of the garbage disposal.

Optionally, the kitchen waste disposal system further includes an operation button. The operation button generates the system starting signal in response to an external operation, such that the garbage disposal is forced to be started manually to switch from a batch feed mode to a continuous feed mode.

Optionally, the kitchen waste disposal system further includes a protective member, a signal generating element, and a signal sensing element. The protective member is movably arranged on the water outlet of the sink. The signal generating element is arranged in the protective member. The signal sensing element generates the system starting signal to the control box in response to an effective sensing of the signal generating element.

Optionally, the protective member is a protective cover shielding the water outlet of the sink. The protective cover includes a close position and an open position for switching between a water cut-off position for blocking the water outlet of the sink and a water passing position for opening the water outlet of the sink.

When the protective cover is in the water passing position, a sensing intensity of the signal sensing element to the signal generating element is at a predetermined threshold value that triggers generation of the system starting signal.

When the cover is in the water cut-off position, the sensing intensity of the signal sensing element to the signal generating element is less than the predetermined threshold value.

Optionally, the protective member is a protective plug inserting into the water outlet of the sink. The protective plug is rotatable at water outlet of the sink.

When the protective plug is inserted into the water outlet of the sink, the protective plug forms a water passing path at the water outlet of the sink.

When the protective plug inserted into the water outlet of the sink is rotated to a specified phase position, the signal generating element is in a phase interval covered by a sensing range of the signal sensing element.

When the protective plug inserted into the water outlet of the sink is rotated away from the specified phase, the signal generating element is outside the phase interval covered by the sensing range of the signal sensing element.

Optionally, the control box starts the garbage disposal in response to a water passing state of the protective member at the water outlet of the sink.

Optionally, the control box stops the garbage disposal and shuts the electric control valve in response to an abnormal state of the garbage disposal.

Optionally, the abnormal state includes a jam state of the garbage disposal, a congested state of water inflow, and an insufficient water supply state.

Optionally, the kitchen waste disposal system further includes a water passing detecting element, the water passing detecting element transmits a detection result of the congested state of the water inflow of the garbage disposal to the control box in response to an abnormal state of a water flowing through the garbage disposal.

Optionally, the water passing detecting element includes a water level sensor arranged in the sink, or a flow sensor arranged in the drainage pipeline or the water supply pipeline of the faucet.

Based on the technical solution in the above embodiment, startup and shutdown of the garbage disposal and the water source of the faucet are synchronously controlled by the control box, thereby simplifying manual operation of a user.

BRIEF DESCRIPTION OF DRAWINGS

The following drawings are only illustrative and explanatory of the present disclosure and are not intended to limit the scope of the present disclosure.

DESCRIPTION OF THE REFERENCE SIGNS

10—sink
100—water outlet
20—faucet
200—control switch
30—drainage pipeline
40—garbage disposal
50—protective plug
51—plug body
52—plug cover
60—electromagnetic valves
70—control box
700—signal sensing element
80—display panel

81—water flow status display area
82—disposal progress display area
90—protective cover

DETAILED DESCRIPTION

The present disclosure will be further described in detail below with reference to the accompanying drawings.

Figure 1:
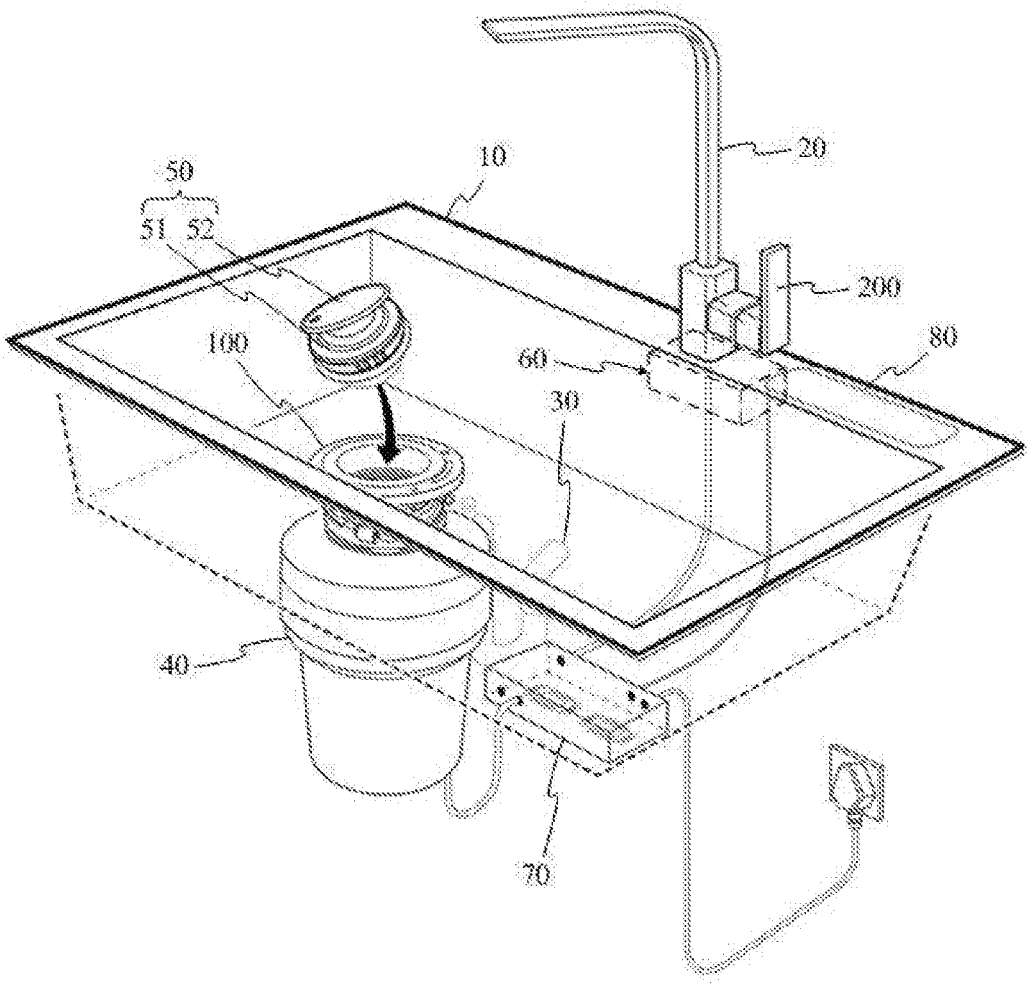
FIG. 1 is a schematic structural diagram of a kitchen waste disposal system of one embodiment of the present disclosure.

FIG. 1 is a schematic structural diagram of a kitchen waste disposal system of one embodiment of the present disclosure. As shown in FIG. 1, in one embodiment, the kitchen waste disposal system is arranged under a sink 10 of the kitchen. The sink 10 includes a faucet 20 and a water outlet 100 discharging water to the drainage pipeline 30.

As shown in FIG. 1, the kitchen waste disposal system includes a garbage disposal 40. The garbage disposal 40 includes a housing and a grinding body arranged inside the housing. The grinding body includes a grinding chamber and a grinding disc. In FIG. 1, the garbage disposal 40 includes a top opening connecting with the water outlet 100 of the sink 10 and a side opening connecting with the drainage pipeline 30. Thus, water discharged from the water outlet 100 flows into the grinding chamber of the garbage disposal 40 through the top opening, and flushes residue waste, so that the residue waste in the grinding chamber is discharged from the side opening to the drainage pipeline 30.

As shown in FIG. 1, the kitchen waste disposal system of the embodiment further includes a protective plug 50, an electric control valve 60, and a control box 70. In FIG. 1, a casing package of the control box 70 independent from the garbage disposal 40 is taken as an example. However, it is understood that the control box 70 is also capable of being placed inside the housing of the garbage disposal 40. For example, there is usually a gap between the grinding body of the garbage disposal 40 and the housing of the garbage disposal 40, and the control box 70 is able to be accommodated in the gap.

The protective plug 50 is removably inserted into the water outlet 100 of the sink 10. That is, the protective plug 50 is able to be placed in the water outlet 100 or removed from the water outlet 100.

When the protective plug 50 is removed from the water outlet 100, the water outlet 100 is fully open so that the kitchen waste in the sink 10 smoothly falls into the grinding chamber of the garbage disposal 40 through the water outlet 100.

When the protective plug 50 is inserted into the water outlet 100, the protective plug 50 is in an in-position state, and the protective plug 50 in the in-position state forms a water passing path at the water outlet 100. That is, the protective plug 50 in the in-position state still allows water flow flows into the grinding chamber of the garbage disposal 40 through the water outlet 100 to flush the residue waste. For example, a gap for flowing through the water flow is formed between the protective plug 50 in the in-position state and an inner wall of the water outlet 100. And in another example, the protective plug 50 includes a water passing pore which the water flow passes.

In addition, the protective plug 50 in the in-position state is movable at the water outlet 100. For example, the protective plug 50 in the in-position state is rotatable at water outlet 100 of the sink 10.

The electric control valve 60 is connected in series with a water supply pipeline of the faucet. Dotted lines indicated by the arrowed wire in FIG. 1 indicates that an installation position of the electric control valve 60 is below the faucet 20, and a main portion of the electric control valve 60 is not clearly shown. It should be understood that the electric control valve 60 is independent from the control box 70 and connected in series with the water supply pipeline of the faucet (i.e., a water and electricity separation mode that the water supply pipeline of the faucet is independent from the control box 70), or the electric control valve 60 is considered to be integrated in the control box 70 (i.e., a hydroelectric integration mode that the water supply pipeline passes through the control box 70).

The electric control valve 60 is installed in a position shown in FIG. 1, so that the electric control valve 60 is located upstream of a faucet control switch 200. Accordingly, a control of the water flow of the faucet 20 is simultaneously constrained by the electric control valve 60 and the faucet control switch 200. That is, when the electric control valve 60 is opened in response to an electrical signal and a mechanical drive of the faucet control switch 200 is opened, the faucet 20 effluents the water. When the electric control valve 60 is shut off in response to the electrical signal and/or the mechanical drive of the faucet control switch 200 is closed, the faucet 20 cuts off the water.

In the present embodiment, opening and closing of the electric control valve 60 is controlled by the control box 70 via the electrical signal. The faucet control switch 200 is considered as a manual gate to the faucet 20. In another embodiment, the faucet control switch 200 is omitted, and the control box 70 totally controls water outlet and water cut off of the faucet 20.

The control box 70 starts the garbage disposal 40 and open the electric control valve in response to a system starting signal. For example, an automatic opening of the electric control valve 60 is not later than an automatic opening of the garbage disposal 40 (preferably earlier than the automatic opening of the garbage disposal 40, so that the water flow flows into the grinding chamber while the garbage disposal 40 is working.

And the control box 70 is further configured to stop the garbage disposal 40 and shut the electric control valve 60 in response to a completion state of a cleaning task of the garbage disposal 40. That is, when the kitchen waste is cleaned up by the garbage disposal 40, the control box 70 automatically stops the garbage disposal 40 and stops the water flow. In an actual design, the control box 70 determines a completion of the cleaning task by using a timing after the garbage disposal 40 is started, or the control box 70 utilizes a load monitoring of the garbage disposal 40 (such as current monitoring of a motor of the garbage disposal 40) to identify the cleaning task is completed or not.

Based on the above embodiment, the start and stop of the garbage disposal 40 and the water source of the faucet are synchronously controlled by the control box 70, thereby simplifying manual operation of the user.

For triggering the system starting signal of the control box 70, as an alternative solution, it can be controlled by an operation button (not shown in FIG. 1) installed at the sink 10, the faucet 20 or other positions. Namely, the operation button generates the system starting signal to the control box 70 in response to an external operation. As an extension of triggering the system starting signal of the operation button, it is also conceivable to provide dedicated buttons for individually starting the garbage disposal 40 and individually controlling the electric control valve 60.

As an alternative solution for triggering the system starting signal generating by the operating button, the system starting signal is generated by means of the protective plug 50. That is, the kitchen waste disposal system of the embodiment shown in FIG. 1 further includes a signal generating element and a signal sensing element. The signal generating element is arranged in the protective plug 50, and the signal sensing element generates the system starting signal to the control box 70 in response to an effective sensing of the signal generating element.

For example, the signal generating element is a magnetic element. Accordingly, the signal sensing element is a magnetic sensor. It is understood that the signal generating element and the signal sensing element are capable of implementing by using elements based on other wireless signal sensing methods, such as radio frequency.

Thus, when the protective plug 50 inserted into the water outlet 100 of the sink 10 is rotated to a specified phase position, the signal generating element is in a phase interval covered by a sensing range of the signal sensing element, so that the signal sensing element generates the system starting signal. When the protective plug 50 inserted into the water outlet 100 of the sink 10 is rotated away from the specified phase, the signal generating element is outside the phase interval covered by the sensing range of the signal sensing element, so that the signal sensing element is prevented from forming the effective sensing of the signal generating element and does not generate the system starting signal.

When the effective sensing of the signal sensing element to the signal generating element disappears, the control box 70 is considered to have received the system stop signal and stops the garbage disposal 40 and shuts the electronic control valve 60.

Figure 2:
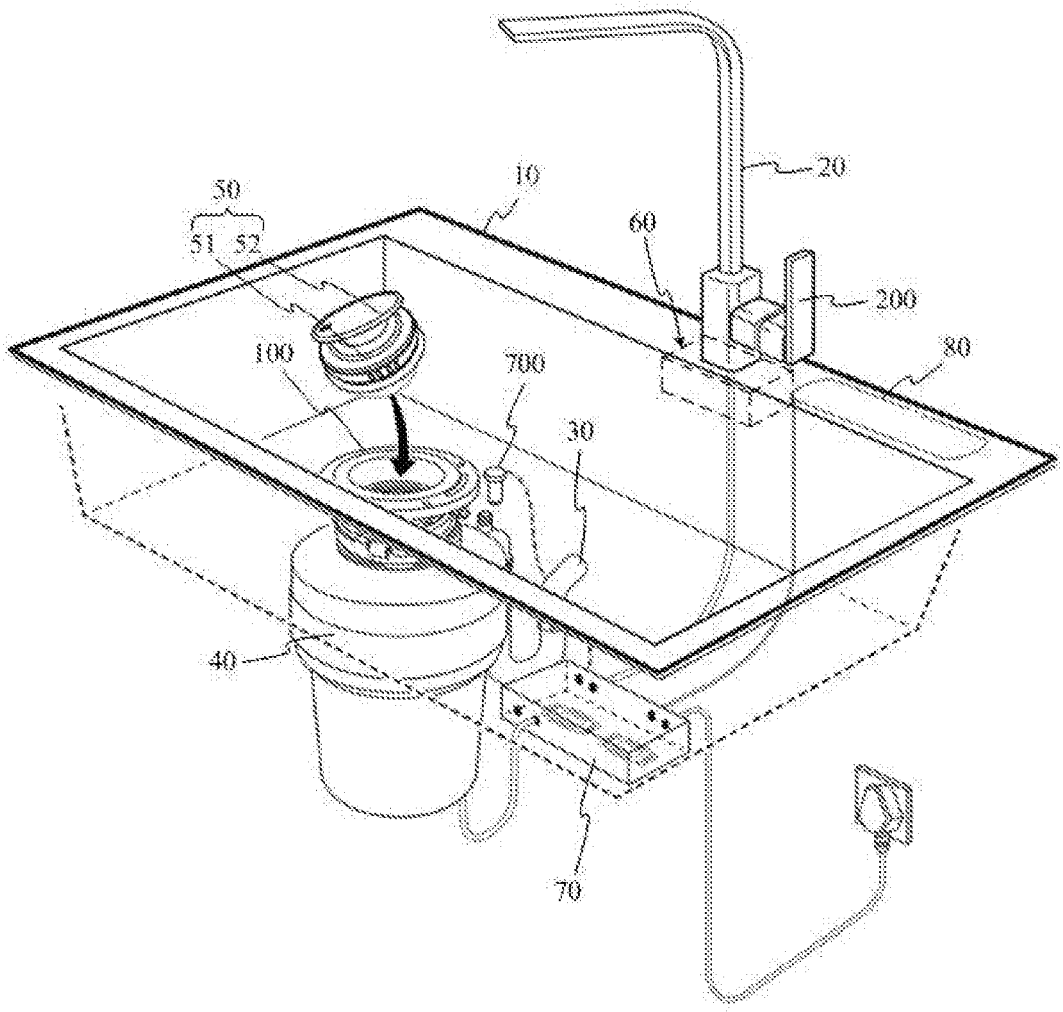
FIG. 2 is a schematic structural diagram of a protective plug of the kitchen waste disposal system shown in FIG. 1.

FIG. 2 is a schematic structural diagram of a protective plug of the kitchen waste disposal system shown in FIG. 1. As shown in FIG. 2, In order to sense the signal generating element arranged in the protective plug 50, the signal sensing element 700 may be integrated at a bottom wall of the sink 10 at a position adjacent to the water outlet 100.

Alternatively, as an alternative solution of FIG. 2, the signal sensing element is alternatively detachably arranged on an outer wall of the water outlet 100 in a manner such as adhesive.

Based on the above-described manner, the protective plug 50 having the function of the physical isolation of the water outlet and the function of preventing splash of the residue waste is able to be used as a trigger actuator for the synchronous control, and a safety of use of the garbage disposal 40 and the backflow of the residue waste is achieved.

Figure 3:
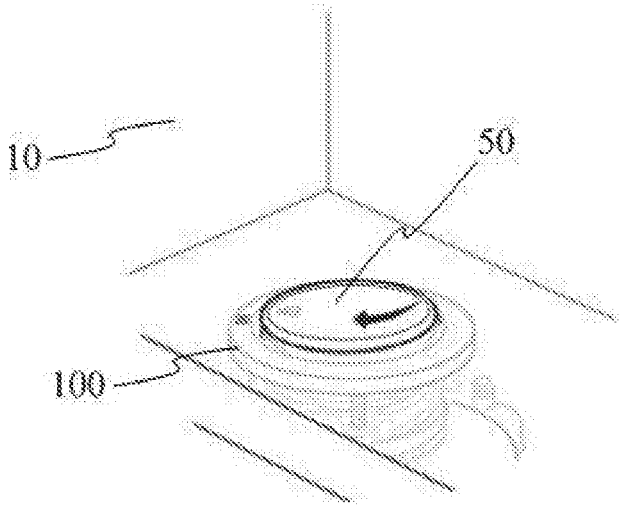
FIG. 3 is a schematic diagram of the protective plug of the kitchen waste disposal system where the protective plug is in a configuration of use.

FIG. 3 is a schematic diagram of the protective plug of the kitchen waste disposal system where the protective plug is in a configuration of use. As shown in FIG. 3, The protective plug 50 is rotatable as indicated by the arrow. Referring to FIG. 3 and in conjunction with FIG. 1, a plug body 51 of the protective plug 50 filled in the water outlet 100 is driven to rotate without affecting the water passing path at the water outlet 100 (a flow gap is formed between the plug body 51 and a side wall of the water outlet 100 or a water passing pore formed in the plug body 51) by manually rotating the plug cover 52 arranged on a top of the protective plug 50.

As an extension, a rotation of the plug cover 52 of the protective plug 50 relative to the plug body 51 changes the water passing and water cut off state of the protective plug 50. That is, the plug body 51 is provided with the water passing pore and the rotation of the plug cover 52 makes the plug cover 52 to switching between opening the water passing pore and closing the water passing pore.

In cases that the protective plug 50 has such structure which is able to adjust between the water passing state and the water cut off state, a pair of signal generating elements are arranged in the protective plug 50, one of which is arranged on the plug body 51 and the other is arranged on the plug cover 52. The pair of signal generating elements form a predetermined phase difference (e.g., 180 degrees), when the plug cover 52 is rotated to open the water passing pore of the plug body 51. Accordingly, the signal sensing elements are arranged in pairs on the side wall of the water outlet 100 or the bottom wall of the sink 10 in accordance with the phase difference described above.

Thus, the control box 70 receives the system starting signal only when the signals generated by the pair of signal generating elements are effectively sensed by the pair of signal sensing elements.

If the effective sensing of one of the signal sensing elements to the signal generating component disappears, or the effective sensing of the signal generating component by the two signal sensing components disappears, the control box 70 is considered to have received the system stop signal and stops the garbage disposal 40 and shuts the electric control valve 60.

Based on such an arrangement, it is considered that the system starting signal is generated in response to the in-position water passing state of the protective plug 50 at the water outlet 100.

In the kitchen waste disposal system of the above embodiment, the control box 70 is further able to stop the garbage disposal 40 and shuts the electric control valve 60 in response to an abnormal state of the garbage disposal 40. The abnormal state may include a jam state of the garbage disposal, a congested state of water inflow, and an insufficient water supply state.

In order to detect the congested state of the water inflow, or the insufficient water supply state of the garbage disposal 40, the kitchen waste disposal system further includes a water passing detecting element that transmits a detection result of the congested state of the water inflow, of the garbage disposal 40 to the control box 70 in response to the abnormal state of a water flowing through the garbage disposal. For example, the water passing detecting element is selected from a water level sensor arranged in the sink 10, or the water passing detecting element is selected from a flow sensor arranged in the drainage pipeline 30 or the water supply pipeline. When a water level in the sink 10 is too high during a startup of the garbage disposal 40, or the flow rate in the drainage pipeline is too small during the startup of the garbage disposal 40, the control box 70 determines that the garbage disposal 40 is blocked. When a water supply flow rate of the water supply pipeline of the faucet is too small or even zero, the control box 70 determines that the garbage disposal 40 is short of water.

As an alternative solution to the detection of the congested state of the water inflow, a floating member (e.g., a member having an average density much smaller than water, such as an air bag) may be arranged on the protective plug 50, and the floating member drives the protective plug 50 to float away from the water outlet 100 in response to a water overflowing from the water outlet 100 into the sink 10, which makes the effective sensing disappear of the signal sensing element 700 to the signal generating element arranged in the protective plug 50. Accordingly, the signal sensing element 700 generates a system stop signal to the control box 70 in response to the disappearance of the effective sensing of the signal generating element to trigger the control box 70 to stop the garbage disposal 40 and shut the electric control valve 60.

In order to detect the jam state of the garbage disposal 40, the control box 70 utilizes load monitoring of the garbage disposal 40 (such as the current monitoring of the motor) to identify the jam state of the garbage disposal. For example, when a sudden change peak of the load is monitored, the garbage disposal 40 is determined to be in the jam state of the garbage disposal.

Alternatively, a protective device may be arranged in the garbage disposal 40, and the protective device automatically powers off the garbage disposal 40 if the garbage disposal 40 is jammed. Accordingly, the control box 70 identifies the jam state of the garbage disposal 40 by detecting a sudden power failure (e.g. startup of the protective device) of the garbage disposal 40. It is understood that the control box 70 may also be equipped with the protective device connected in series with the system power supply loop of the overall system including the garbage disposal 40. That is, the control box 70 controls the load state of the garbage disposal 40, so that controls the on/off of a power supply circuit of the kitchen waste disposal system.

For a communication connection between the control box 70 and other components, a cable connection or a wireless communication connection may be used.

The kitchen waste disposal system of the above embodiment further includes a display panel 80. As shown in FIG. 1, the display panel 80 is disposed on a side of the sink 10. Of course, the display panel 80 may be disposed on a faucet 20 of the sink 10 instead.

Figure 4:
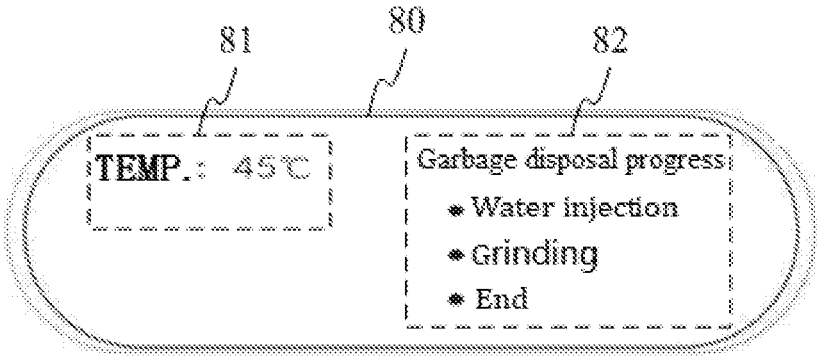
FIG. 4 is a schematic diagram of a display module of a control panel of the kitchen waste disposal system shown in FIG. 1.

FIG. 4 is a schematic diagram of a display module of a control panel of the kitchen waste disposal system shown in FIG. 1. As shown in FIG. 4, the display panel 80 includes a water flow state display area 81 and a disposal progress display area 82 of the garbage disposal 40.

The water flow state display area 81 displays parameters such as temperature or flow rate of the water flow, and these parameters are sensed by various types of sensors arranged in the water supply pipeline of the faucet and reported to the control box 70. As a further supplement, the water flow state display area 81 can also graphically simulate the dynamic display of the water flow when the electric control valve 60 is opened to produce a visually pleasing visual effect.

The disposal progress display area 82 displays a working state of the garbage disposal 40 in a manner that a disposal node is highlighted. For example, the working state includes an instantaneous power of the garbage disposal 40, a disposal capacity occupancy rate of the garbage disposal 40, and the like.

Water injection The sink 10 further includes a sensor module for sensing user proximity behavior and environmental parameters such as brightness. When a surrounding environment is dim and the user is close to the sink 10, an LED light of the display panel 80 is powered on to produce an effect of night light lighting.

Figure 5:
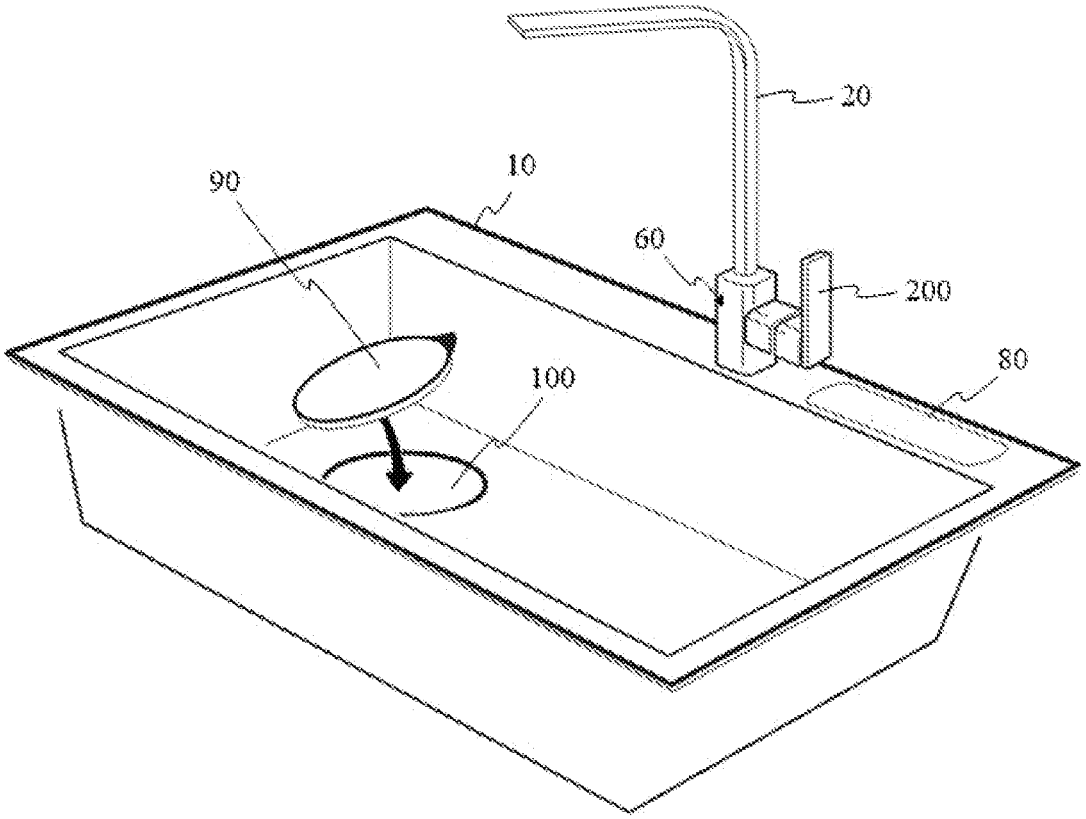
FIG. 5 is a partial schematic diagram of a kitchen waste disposal system of another embodiment of the present disclosure.

FIG. 5 is a partial schematic diagram of a kitchen waste disposal system of another embodiment of the present disclosure. As shown in FIG. 5, in another embodiment, the protective plug 50 as a protective member in FIG. 1 is replaced with a protective cover 90 that shields the water outlet 100.

The protective cover 90 has a close position and an open position of switching between a water cut-off position for blocking the water outlet 100 of the sink and a water passing position for opening the water outlet 100 of the sink. The open position and the close position are a lifting type, and the lifting type open position and close position may be pure manual manipulation as shown in FIG. 5.

As an alternative solution, the lifting type open position and close position of the protective cover 90 are a manual actuation based on mechanical transmission or an electronically controlled actuation based on a drive mechanism.

The protective cover 90 in the water cut-off position completely closes the water outlet 100 so that water is stored in the sink 10 when the faucet 20 is open.

The protective cover 90 in the water passing position allows the kitchen waste in the sink 10 to smoothly fall into the grinding chamber of the garbage disposal 40 through the water outlet 100, and allows the water flow to flow into the grinding chamber of the garbage disposal 40 through the water outlet 100 to flush the residue waste.

Moreover, in the embodiment shown in FIG. 5, the protective cover 90 as the protective member also includes the signal generating element as that of the protective plug 50. Accordingly, the signal sensing element is arranged on the sink 10 or the water outlet 100.

When the protective cover 50 is in the water passing position, a sensing intensity of the signal sensing element to the signal generating element is at a predetermined threshold value that triggers generation of the system starting signal.

When the cover is in the water cut-off position, the sensing intensity of the signal sensing element to the signal generating element is less than the predetermined threshold value to prevent the signal sensing element from generating the system starting signal.

Compared to a centralized kitchen waste disposal mode using the protective plug 50 as shown in FIG. 1, the use of the protective cover 90 allows a continuous feed kitchen waste disposal mode. That is, during the startup of the garbage disposal 40, the kitchen waste is continuously flowing into the waste along with the water flow.

Of course, the kitchen waste disposal mode allowed by the protective plug 50 may not be limited to the centralized type. If a protection strength of the protective plug 50 is properly sacrificed, the continuous feed kitchen waste disposal mode is implemented based on the protective plug 50. For example, if the water passing pore of the protective plug 50 is sufficiently large, or the protective plug 50 is completely configured as a hollow structure, the continuous feed kitchen waste disposal mode is also realized.

In addition, in a case that the lifting type open position and close position of the protective cover 90 is electrically controlled, the signal generating element and the signal sensing element are not required. And a one-key linkage control is realized by a dedicated button. That is, the system starting signal generated by an operation to the dedicated button controls the protective cover 90 to reach the water passing position first, and then starts the garbage disposal 40 and opens the electric control valve 60. Further, when any of foregoing conditions that trigger the garbage disposal 40 to stop and the electric control valve 60 to close are met, the dedicated button automatically controls the protective cover 90 to return to the water cut-off position or to other locations away from the water outlet 100.

In the embodiments shown in FIGS. 1 and 5, the water source discharged from the faucet 20 is controlled by the electric control valve 60. However, in an actual design, an independent water port may be arranged on the water supply upstream of the faucet 20. The water port may be located in the sink 10 or directly connected to the grinding chamber of the garbage disposal 40 without passing through the sink. Accordingly, the electric control valve 60 herein is configured as a switch valve of the water port. Thus, opening and closing controls of the faucet 20 and the electric control valve 60 are independent from each other.

The above are only the preferred embodiments of the present disclosure, and are not intended to limit the present disclosure. Any modifications, equivalents, improvements, etc., which are made within the spirit and principles of the present disclosure, should be included within the scope of the present disclosure.

What is claimed is:

1. A kitchen waste disposal system, comprising:

a garbage disposal having a top opening connected with a water outlet of a sink and a side opening connected with a drainage pipeline;

a control box;

a protective plug, a first signal generating element, a second signal generating element, a first signal sensing element and a second signal sensing element;

wherein the control box is configured to start the garbage disposal and open an electric control valve in series with a water supply pipe of a faucet in response to a system starting signals; and the control box is further configured to stop the garbage disposal and shut the electric control valve in response to a completion state of a cleaning task of the garbage disposal;

wherein the protective plug is movably arranged on the water outlet of the sink; the protective plug comprises a plug body and a plug cover; the first signal generating element is arranged on the plug body and the second signal generating element is arranged on the plug cover; the first signal sensing element and the second signal generating element are integrated at a bottom wall of the sink at a position adjacent to the water outlet;

the plug body is provided with a water passing pore and the plug cover is rotatable to make the plug cover switch between opening of the water passing pore and closing of the water passing pore;

wherein each of the first signal sensing element and the second signal generating element generates a system starting signal to the control box in response to an effective sensing of corresponding signal generating elements.

2. The kitchen waste disposal system according to claim 1, wherein the kitchen waste disposal system further comprises an operation button, the operation button generates the system starting signals in response to an external operation, such that the garbage disposal is forced to be started manually to switch from a batch feed mode to a continuous feed mode.

3. The kitchen waste disposal system according to claim 1, wherein the control box starts the garbage disposal in response to a water passing state of the protective member at the water outlet of the sink.

4. The kitchen waste disposal system according to claim 1, wherein the control box stops the garbage disposal and shut the electric control valve in response to an abnormal state of the garbage disposal.

5. The kitchen waste disposal system according to claim 4, wherein the abnormal state comprises a jam state of the garbage disposal, a congested state of water inflow, and an insufficient water supply state.

6. The kitchen waste disposal system according to claim 5, wherein the kitchen waste disposal system further comprises a water passing detecting element, the water passing detecting element transmits a detection result of the congested state of the water inflow of the garbage disposal to the control box in response to an abnormal state of a water flowing through the garbage disposal.

7. The kitchen waste disposal system according to claim 6, wherein the water passing detecting element comprises a water level sensor arranged in the sink, or a flow sensor arranged in the drainage pipeline or the water supply pipeline of the faucet.

8. The kitchen waste disposal system according to claim 1, wherein the one of the signal generating elements arranged on the plug cover generates one of the system starting signals when the plug cover is rotated to open the water passing pore of the plug body.

9. The kitchen waste disposal system according to claim 8, wherein the protective plug is insertable into the water outlet of the sink; the protective plug is rotatable at the water outlet of the sink;

wherein when the protective plug is inserted into the water outlet of the sink, and the plug cover is rotated to open the water passing pore, the protective plug forms a water passing path at the water outlet of the sink;

when the protective plug inserted into the water outlet of the sink is rotated to a specified phase position, the first signal generating element and the second signal generating are in a phase interval covered by a sensing range of the first signal sensing element and the second signal sensing element; and when the protective plug inserted into the water outlet of the sink is rotated away from the specified phase, the first signal sensing element and the second signal sensing element are outside the phase interval covered by the sensing range of the first signal sensing element and the second signal sensing element.

* * * * *